United States Patent [19]

Levine

[11] Patent Number: 4,482,150

[45] Date of Patent: Nov. 13, 1984

[54] HEAVY BAG AND STAND

[76] Inventor: Norman D. Levine, 1300 SW. 12th Ave., Pompano Beach, Fla. 33060

[21] Appl. No.: 346,892

[22] Filed: Feb. 8, 1982

[51] Int. Cl.[3] ..... A63B 69/00

[52] U.S. Cl. ..... 272/78

[58] Field of Search ..... 272/78, 77, DIG. 9; 273/55 R

[56] References Cited

U.S. PATENT DOCUMENTS

| | | | |
|---|---|---|---|
| 843,389 | 2/1907 | Brown | 272/78 |
| 2,625,356 | 1/1953 | Kennedy et al. | 272/78 |
| 3,411,497 | 11/1968 | Rickey et al. | 272/78 |
| 3,510,131 | 5/1970 | Gardner | 272/78 |

OTHER PUBLICATIONS

Sporting Goods Dealers, p. 235, 1-1981.

*Primary Examiner*—Richard C. Pinkham
*Assistant Examiner*—T. Brown
*Attorney, Agent, or Firm*—Eugene F. Malin

[57] ABSTRACT

A heavy body bag support stand mounted partially under a platform on which the user stands to anchor the body bag to the floor by the use of the boxers weight, when the heavy body bag is used. The stand supports the platform along one edge and spaced from a support floor to provide a resilient platform. The support stand is formed of conduit with conduit braces attached by connecting means. An adjustable light weight bag carrying member may be connected near the top of the support stand.

3 Claims, 8 Drawing Figures

HEAVY BAG AND STAND

BACKGROUND OF THE INVENTION

In the past, light punching bag supports have been constructed such as disclosed in U.S. Pat. No. 3,510,131. Such lightweight bag stands have been large structures with intergral platforms fixed to the stand. The platforms are generally of rigid construction and are fixed to the stand. Due to the heavier weight of a body bag devices and the increased stress required for their support due to the heavier type punching for which they are commonly used, body bags are usually suspended from a permanent building structure such as a wall or ceiling member.

SUMMARY OF THE INVENTION

This invention relates to a relatively lightweight support stand for a combination heavy body bag and light punching bag for adult use which can also be used for jumping rope and other exercises. In this invention the position of the boxers body on the platform and the flexibility and resilience of the platform in relationship to the heavy body bag and support stand provides an improved portable stand. The stresses placed on the support stand by a heavy bag in movement due to a boxers full body blows with his fists are overcome by the present invention. This invention uses a removably attached piece of plywood upon which the boxer stands to provide a support that uses the weight and movement of the boxer to aid in supporting the heavy body bag. One edge of the plywood sheet is attached to a cross member of the support stand and places the weight of the boxer away from the support stand on a resilient central portion of the platform. The support stand has a structure that will withstand heavy punching, especially with a body bag connected to the carrying member at the top of the support stand. The plywood platform may be shipped with the device to the user with the support stand, or because of its simple shape and construction, the user may also purchase the platform locally and add it to the support stand. The platform includes brackets for connecting the platform to the support stand that are included with the support stand. The platform may include adjustable blocks beneath the platform to adjust the resilience of the platform.

It is an object of this invention to provide a support stand that may be shipped with or without a platform, but may be easily connected or unconnected from the support stand.

Another object of this invention is to provide an resilient platform with adjustable flexibility that aids in supporting a body bag on a portable support stand.

A further object of this invention is to provide a body bag support stand that may be used as an adjustable jump rope jumping platform or a platform for other exercises.

It is yet another object of this invention to provide a combination heavy body bag and light punching bag stand with at least one resilient platform that aids in supporting the heavy body bag.

In accordance with these and other objects which will be apparent hereinafter, the instand invention will now be described with particular reference to the accompanying drawings.

DESCRIPTION OF PREFERRED EMBODIMENT

Figure 1:
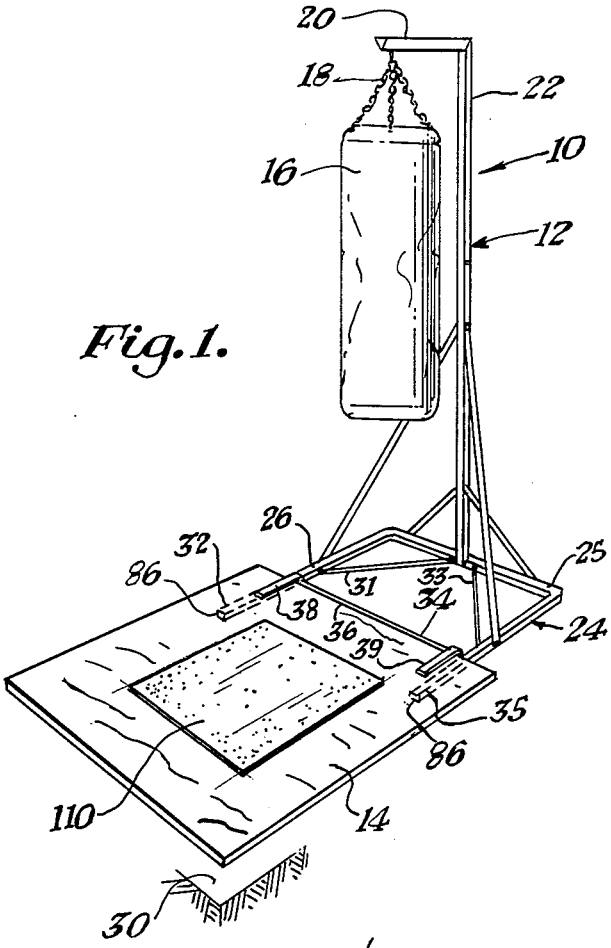
FIG. 1 is an isometric view of the support stand and platform.
Figure 6:
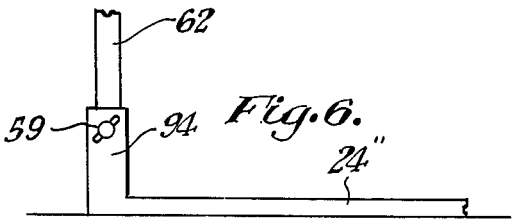
FIG. 6 is a partial side view of the stand showing one releasing means.

Referring now to FIG. 1 showing a heavy bag support stand 10 with a frame 12, a removable resilient platform 14 and a heavy bag 16. The bag 16 is connected by chains 18 to carrying members 20 connected by a weld to vertical members 22. The vertical members 22 may be welded to the floor frame 24 or the end 62 shown in FIG. 6 may be removably connected into a larger short vertical member or pipe 94 that is part of 24'' and fixed in place by wing nut 59 as illustrated in FIG. 6. Also end 61 in FIG. 2 on vertical member 12' may be in contact with the floor and may be bolted to horizontal members 24' and 26'. One or more bolts 26'' may be used to hold the two members 12' and 24' to member 61.

Figure 2:
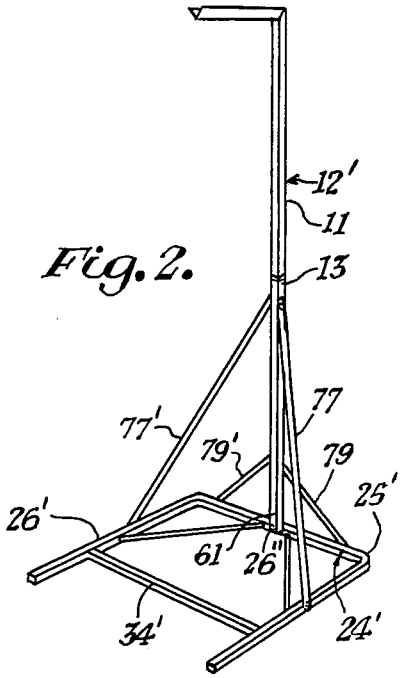
FIG. 2 is an isometric view of another embodiment.
Figure 4:
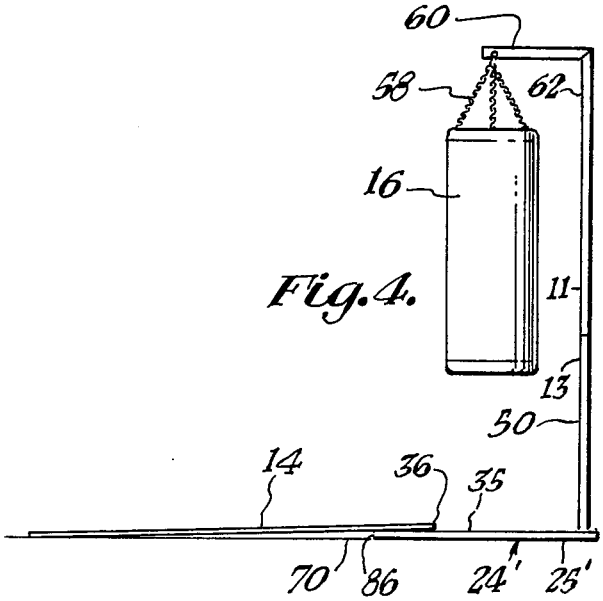
FIG. 4 is a partial side view of FIG. 2 with a platform.

The floor frame 24 and 24' is placed on floor 30 and 70 respectively as shown in FIGS. 1 and 2. The floor frame 24' may include a right member 25' and a left member 26'. The right member 25' and the left member 26' may be held by separate bolts (not shown) to the vertical member 12'. The frame 24 may include cross members 31, 33 and 34, held together by nuts and bolts. The ends of members 25 and 26 are shown as members 32 and 35 and are used to support the front edge 36 of platform 14 off of the floor 30 or 70 as shown in FIGS. 1 and 4. Ends 86 show the distance the platform is held off the floor in order to provide resilience. Connectors 38 and 39 may be screwed or bolted onto the top of platform 14. The L-shaped or C-shaped ends on the connectors may be placed beyond the edge 36 to lay over cross member 34. The platform 14 is a resilient platform that will bounce with a user. The platform, 14 may be a 4 foot by 4 foot fur plywood board with a non skid surface portion 110, which may also be under tabs, FIG. 7.

Figure 7:
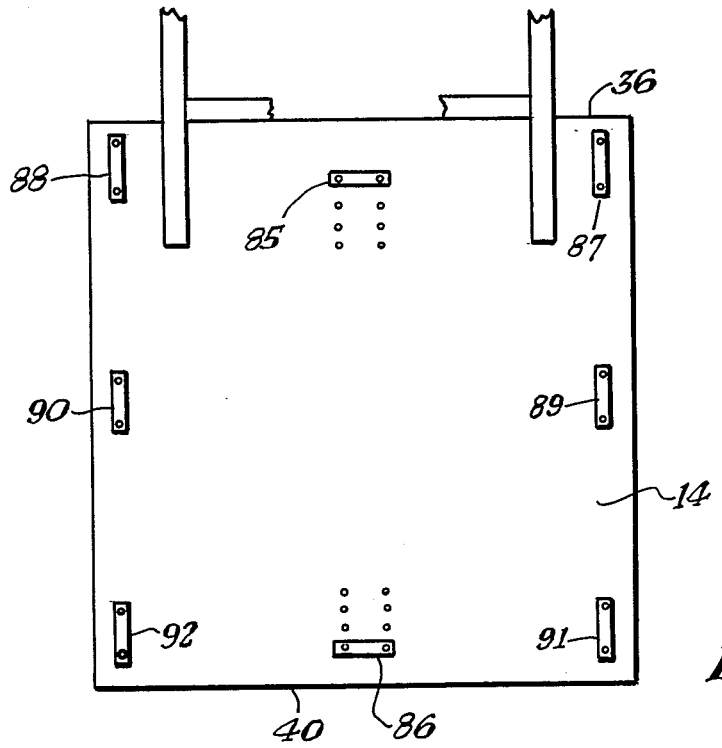
FIg. 7 is a bottom view of another embodiment of the platform with a portion of the stand shown.

It should be noted that platform 14 as shown in FIG. 7 has rear edge 40 that may be elevated by a plurality of blocks or tabs 85, 86, 87, 88, 89, 90, 91 and 92. This aids ends 86 that may be 8 inches from edge 36 in FIG. 1 to hold the platform above the floor, leaving the center portion of platform 14 where the non skid pad 110 is located, relatively free to flex under the weight and movement of the athlete or user. The tabs are screwed or bolted into the platform. Tabs 86 and 85 are adjustable by movement and connection with nuts in openings in the plurality of holes shown in FIG. 7.

Referring now to FIG. 4 a heavy bag 16 on frame member 60 is welded to portion 62 with a platform 14 on the ends 86. The bag 16 is moveably and adjustably connected by a chain 58 to a carrying member 60 that is connected to vertical member 22. The vertical member 22 may be welded to the floor frame members 24 or may be removably connected as shown in FIGS. 6 and 2.

Figure 3:
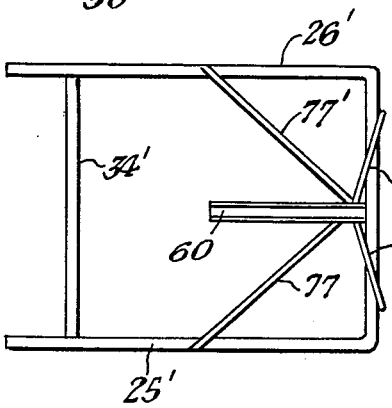
FIG. 3 is a partial top view of FIG. 2.

The floor frame 24' is placed on floor 70. The floor frame 24' may include cross members similar to those shown in FIG. 1. Additional supports 77, 79, 77' and 79' shown in FIGS. 2 and 3 may be screwed or bolted onto the horizontal and vertical members. The resilient platform will bounce since at least one edge and preferrably all edges as shown in FIG. 7 are off the floor. The center portion of the platform is held above the floor and is allowed to move up and down with the movement of the user.

Figure 5:
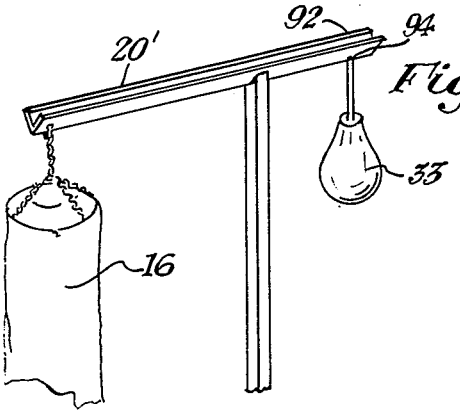
FIG. 5 is an isometric view of a portion of the combination heavy body bag and light punching bag stand.

Referring now to FIG. 5 the instant invention is shown with a combination heavy body punching bag and light punching bag combination stand. The platform 14 may be attached under the heavy body bag 16 or placed under the light bag 33. The light punching bag 33 is connected to suspension member 20' at end portion 92. The light punching bag 33 is swivelly mounted to the extension member 92 at point 94. A well known circular back board may be placed in a horizontal position below portion 92'. In this manner, the invention can be used as both a heavy body punching bag held on member 20' and a light punching bag device held on the other end of member 20' on portion 92.

Figure 8:
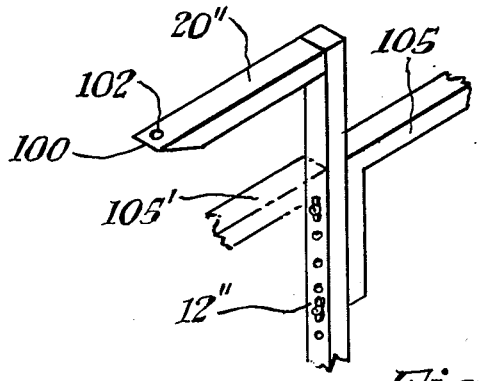
FIG. 8 is another embodiment of the combination heavy body bag and light punching bag supports.

Referring to FIG. 8, the vertical post 12" may include a preferred welded square conduit 20" in a horizontal position with an angle end cut at 100 allowing a chain to be connected through opening 102 to hold the heavy bag. A plurality of openings may be placed in vertical member 12" to allow the movable L-shaped light bag frame 105 to be placed at a variety of heights on vertical member 12". The L-shaped frame 105 may be used on the rear as shown or may be placed on the forward side for use as shown in phantom at 105'. The horizontal member 105 may include a cross member to give added support to a circular back board positioned between the member 105 and the bag 33. The L-shaped member is held by nuts and bolts shown. The L-shaped member may have a horizontal back board below the horizontal arm and may support the light weight punching bag at the distal end of the horizontal arm.

The device may be sold as a nine piece item, 22, 25, 26, 31, 33, 77, 77', 79 and 79'. The vertical member 12 may be in two pieces with an upper piece 11 and a lower straight piece 13 connected in the upper piece 11.

It should be noted that a non skid material 110 in FIG. 1 may be placed on the board and aid in preventing slips especially if water is dropped thereon. Bathtub-type skid material may be used such as a vinyl pad with an upper surface of grit.

It should also be noted that members 31 and 33 may be welded in place. Also members 79 and 79' may be a bent one piece item generally V-shaped instead of in two pieces. Members 77 and 77' may also be made as a V-shaped one piece member.

The heavy bag may be from forty (40) pounds to one hundred sixty (160) pounds or more.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination heavy body punching bag, support stand and platform, comprising:

a heavy body punching bag;

a resilient removable platform means having a top surface, a bottom surface, a central portion, a first edge and a second edge;

a support means suspending said body bag above the platform, said support means having a floor frame means for placement on a floor, a vertical frame means connected at its lower end to said floor frame means, a horizontally extending cantilevered heavy bag suspension member the upper end of said vertical frame means for suspending said body bag above said platform;

an attachment means connecting said body bag to said horizontal suspension member; a bracket means connected to said floor frame means, said bracket means releasably connected to said first edge of said platform to serve as the sole support for elevating said bottom surface above a support floor.

2. A combination heavy body punching bag, support stand and platform as set forth in claim 1, wherein;

said body punching bag is removeably connected to said horizontal suspension means;

said vertical member is removeably connected to said floor frame means.

3. A combination heavy body punching bag, support stand and platform, as set forth in claim 1 wherein: said vertical frame means is vertically adjustable.

* * * * *